United States Patent [19]

Gillis et al.

[11] Patent Number: 4,637,473

[45] Date of Patent: Jan. 20, 1987

[54] FIRE SUPPRESSION SYSTEM

[75] Inventors: Joseph P. Gillis, Westboro; Norval M. Jess, Wrentham, both of Mass.

[73] Assignee: Kidde, Inc., Saddle Brook, N.J.

[21] Appl. No.: 819,393

[22] Filed: Jan. 16, 1986

[51] Int. Cl.[4] ..... A62C 37/04

[52] U.S. Cl. ..... 169/61; 55/217; 55/302; 55/432; 169/66; 406/12

[58] Field of Search ..... 169/48, 49, 54, 56, 169/60, 61, 66, 68; 406/12, 172; 55/217, 302, 432

[56] References Cited

U.S. PATENT DOCUMENTS

| | | | |
|---|---|---|---|
| 3,480,330 | 11/1969 | Hirs et al. | 406/172 |
| 3,521,430 | 7/1970 | Vanderlip et al. | 406/172 X |
| 3,912,015 | 10/1975 | Garbee et al. | 169/61 |
| 4,281,717 | 8/1981 | Williams | 169/66 X |
| 4,487,266 | 12/1984 | Gillis et al. | 169/66 X |

FOREIGN PATENT DOCUMENTS

| | | | |
|---|---|---|---|
| 145707 | 1/1981 | Fed. Rep. of Germany | 169/54 |

*Primary Examiner*—Andres Kashnikow
*Attorney, Agent, or Firm*—John E. Toupal; Harold G. Jarcho

[57] ABSTRACT

A fire suppression system including a housing for receiving particulate matter and defining an inlet opening and an outlet opening, an input duct connected to the inlet opening, an air mover for forcing air through the input duct into the housing and out of the outlet openings, and filter means disposed in the housing and sealed between the inlet opening and the outlet opening so as to remove in the housing the particulate matter entrained by air entering through the inlet opening. Also included are an inlet sensor providing an inlet output signal dependent on the inlet temperature of combined gas and particulate matter entering the housing through the inlet opening, an outlet sensor providing a discharge output signal dependent on the outlet temperature of air discharged through the outlet opening, and a difference circuit receiving the inlet and discharge output signals and providing a difference signal in response to a predetermined minimum difference therebetween. A detector provides a detection signal in response to the presence of combustion products within the enclosure and a control circuit responds to the difference signal by deactivating the air mover and responds to the detection signal by activating an actuator to release a fire extinguishing agent into the housing.

20 Claims, 2 Drawing Figures

FIRE SUPPRESSION SYSTEM

BACKGROUND OF THE INVENTION

This invention relates generally to a fire suppression system and, more particularly to a system for detecting and extinguishing fires in enclosures for collecting particulate material.

Historically, effective fire protection for installations in which bag filters are used for dust collection has proven quite challenging for a number of reasons. One problem results from the high air velocities which deter rapid detection of a fire in the collection enclosure. Although fixed temperature or rate-of-rise thermal detectors provide rapid and reliable fire detection in many types of process equipment, in dust collector enclosures, which normally operate with very high air velocities, a total inferno involving the entire collector may develop before there is sufficient thermal energy to alarm a heat detector. A fire at this late detection stage may have consumed or damaged most of the filter bags, support cages, venturis, tube sheet and possibly even the collector structure. Optical detectors, on the other hand, which respond to ultraviolet or infrared radiation emitted from the fire are "blinded" by dust and do not always operate effectively while requiring constant and regular inspection and maintenance. In addition, extinguishing a fire of significant magnitude with either water or a chemical extinguishing agent is difficult and messy. Large quantities of extinguishing agent are needed to thoroughly drench all the filter bags and costly downtime results until the collector enclosure is refurbished or replaced.

SUMMARY OF THE INVENTION

This invention is a fire suppression system including a housing for receiving particulate matter and defining an inlet opening and an outlet opening, an input duct connected to the inlet opening, an air mover for forcing air through the input duct into the housing and out of the outlet openings, and filter means disposed in the housing and sealed between the inlet opening and the outlet opening so as to remove in the housing the particulate matter entrained by air entering through the inlet opening. Also included are an inlet sensor providing an inlet output signal dependent on the inlet temperature of combined gas and particulate matter entering the housing through the inlet opening, an outlet sensor providing a discharge output signal dependent on the outlet temperature of air discharged through the outlet opening, and a difference circuit receiving the inlet and discharge output signals and providing a difference signal in response to a predetermined minimum difference therebetween. A detector provides a detection signal in response to the presence of combustion products within the enclosure and a control circuit responds to the difference signal by deactivating the air mover and responds to the detection signal by activating an actuator to release a fire extinguishing agent into the housing. Rapid fire detection is accomplished by first sensing a temperature difference of the predetermined minimum level between the enclosure inlet and the enclosure outlet and deactivating the air mover to create a static air condition within the housing, and then detecting combustion products with the strategically mounted detector.

According to one feature of the invention, the system includes a shut-off activatable to block air flow through the housing between the inlet and outlet openings and the control circuit is further adapted to activate the shut-off means in response to the difference signal. The shut-off provides an immediate termination of air flow after deactivation of the air mover.

According to another feature of the invention, the system includes a filter cleaning means activatable to remove particulate matter deposited on the filter means and the control circuit is further adapted to deactivate the cleaning means in response to the difference signal. Deactivation of the cleaning means suspends the dislodgement of particulate material that could contribute to the detected fire.

According to yet another feature of the invention, the system includes a removal means activatable to effect removal of particulate matter accumulated in the enclosure and the control circuit is further adapted to deactivate the removal means in response to the difference signal. Deactivation of the removal means prevents escape from the enclosure of fire damaged material that could contaminate previously removed particulate matter.

According to still other features of the invention, the shut-off is a damper disposed in an outlet duct connected to the outlet opening, the extinguishing agent is a halogenated agent, the detector comprises temperature detection means, and the inlet and outlet sensors comprise thermocouples. This arrangement facilitates the rapid detection and extinguishing agent of fire within the housing.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
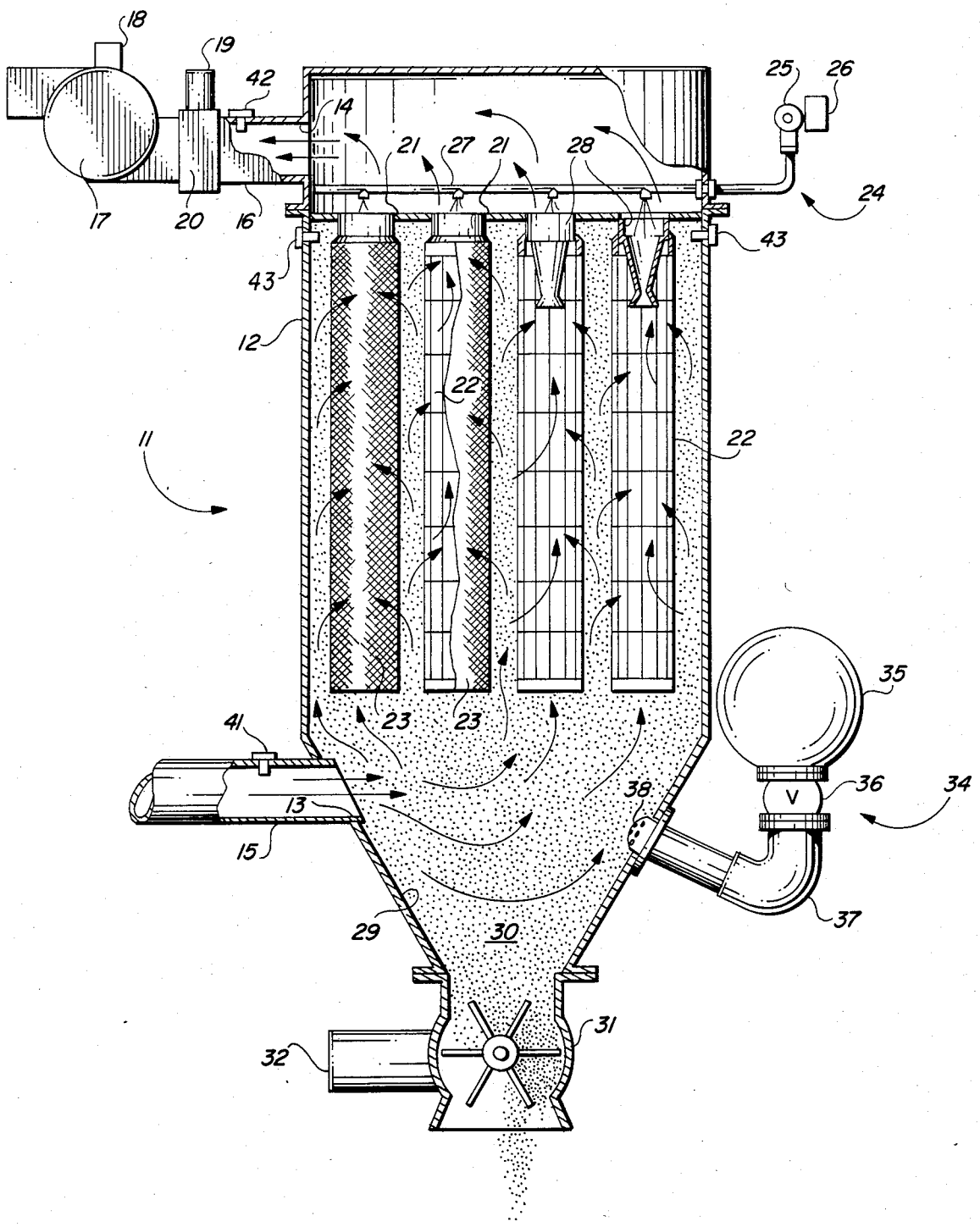
FIG. 1 is a schematic diagram illustrating a fire suppression system according to the invention.

FIG. 1 depicts a fire suppression system 11 for suppressing fires in fabric collection apparatus tha collects particulate matter such as coals, grains, foods and other organic material. An enclosure housing 12 for collecting the particulate matter includes an inlet opening 13 and an outlet opening 14. Connected to the inlet opening 13 is an inlet duct 15 while an outlet duct 16 connected between the outlet opening 14 and an air moving blower 17 driven by a motor 18. An operating solenoid 19 actuates a flow control shut-off damper 20 disposed in the outlet duct 16 between the blower 17 and the outlet opening 14. Mounted within the housing 12 is a tube sheet 21 that supports a plurality of support cages 22 each retaining a fabric filter bag 23. The tube sheet 21 creates a seal between the inlet opening 13 and the outlet opening 14 that limits air flow to paths that include the filter bags 23. Also included in the system 11 is an agitator mechanism 24 that provides periodic agitation of the filter bags 23 to effect cleaning thereof. The agitator mechanism 24 consists of a compressed air supply 25 connected to a distribution pipe 27 by a valve actuated by a solenoid 26. Outlet openings in the distribution pipe 27 periodically discharge compressed air into a venturi nozzle 28 positioned in the upper portion of each support cage 22 so as to produce therein high velocity surges. Those air surges agitate the retained filter bag 23 to dislodge therefrom accumulated particulate matter. Defined by the housing 12 is a collection chamber 29 in which particulate matter 30 accumulates. Removal of the particulate matter 30 from the housing 12 is accomplished through a rotary airlock valve 31 that is actuated by a drive mechanism 32.

A fire suppressor unit 34 is mounted externally of the housing 12. Included in the suppressor unit 34 is a vessel 35 that retains a supply of a fire extinguishing agent such as liquified halon 1301. Connected to the vessel 35 by an agent discharge valve 36 is a discharge pipe 37 that extends into the enclosure 12 and is terminated by a discharge nozzle 38. In many applications, a plurality of suppressor units 34 are provided for a given housing 12.

Positioned within the inlet duct 15 adjacent to the inlet opening 13 is an inlet sensor 41 that produces an inlet output signal dependent on the inlet temperature of a particulate matter and gas mixture flowing into the housing 12. Similarly positioned within the outlet duct 16 adjacent to the outlet opening 14 is an outlet sensor 42 that provides a discharge output signal dependent upon the temperature of air leaving the housing enclosure 12. Preferably, the inlet sensor 41 and the outlet sensor 42 are thermocouples. The eminent presence of fire within the housing 12 is detected by one or more combustion products detectors 43. A preferred combustion products detector is the Detect-A-Fire temperature sensor marketed by Kidde, Inc.

Figure 2:
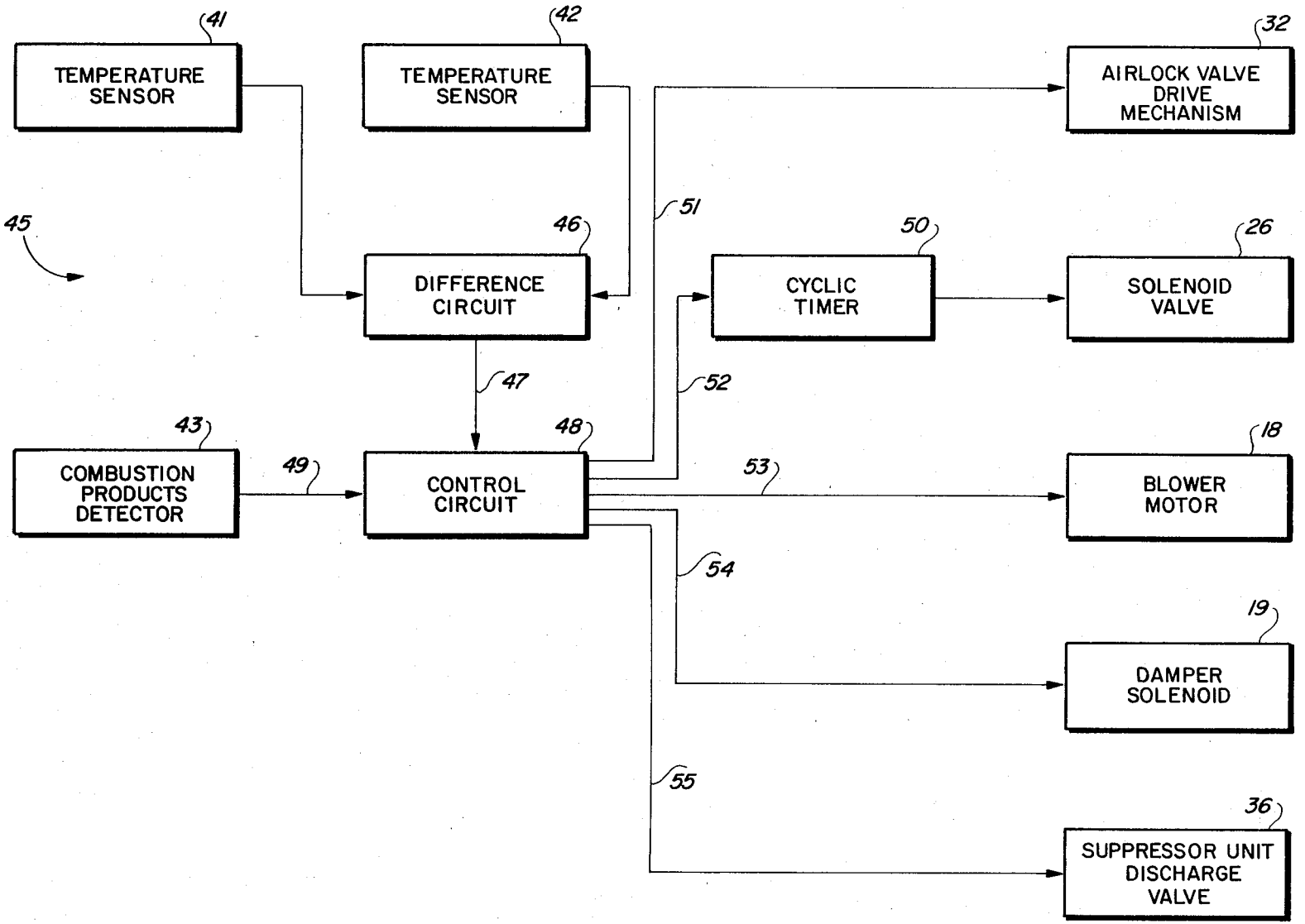
FIG. 2 is a schematic block circuit diagram illustrating an electrical control system for the tire suppression system shown in FIG. 1.

An electrical system 45 for controlling the fire suppression system 11 is shown in block circuit diagram form in FIG. 2. A difference circuit 46 receives the inlet output signal from the inlet sensor 41 and the discharge output signal from the outlet sensor 42. The difference circuit 46 provides on line 47 a difference signal in response to a predetermined minimum difference between the temperature of combined particulate matter and air entering the housing 12 through the inlet opening 13 and the temperature of air leaving the housing 12 through the outlet opening 14. Receiving the difference signal on line 47 is a control circuit 48 that also receives on line 49 detection signals provided by the combustion products detectors 43. The control circuit 48 provides on lines 51 and 52, respectively, output signals to the airlock drive mechanism 32 and a cyclic timer 50 operatively connected to the solenoid valve 26 of the agitator 24. Also provided by the control circuit 48 on lines 53 and 54, respectively, are output control signals to the blower motor 18 and the damper solenoid 19. The control circuit 48 additionally provides on line 55 an output signal to the discharge valve 36 of the suppression unit 34.

OPERATION

During normal operation of the system 11, the blower 17 is driven by the motor 18 to provide air flow through the inlet duct 15, flow paths in the housing 12 including the filter bags 23 and the outlet duct 16 through the open damper 21. Particulate matter entrained with the air entering the inlet opening 13 is intercepted by the filter bags 23 and deposited by gravity into the collection hopper 29. Accumulated particulate matter 30 periodically is removed from the hopper 29 via the rotary airlock valve 31 under control of the airlock drive mechanism 32. Particulate matter accumulated on the external surfaces of the filter bags 23 is periodically dislodged by the agitator mechanism 24 under control of the cyclic timer 50. In the absence of conditions that result in the generation of excessive heat within the housing 12, the difference in temperature sensed by the inlet sensor 41 and the outlet sensor 42 remains below a predetermined minimum level and no difference output signal is produced by the difference circuit 46 on the output line 47 (FIG. 2).

The generation of heat accompanying combustion within the housing 12 increases the difference in temperature sensed by the inlet sensor 41 and the outlet sensor 42. When that difference reaches a predetermined minimum level, (typically, 10° F. to 28° F. depending on process operating parameters) the difference circuit 46 produces on line 47 an output signal that is applied to the control circuit 48 (FIG. 2). In response to that difference signal, the control circuit 48 produces output control signals on lines 51–55. The output signals on lines 53 and 54, respectively, deenergize the motor 18 to deactivate the blower 17 and energize the solenoid 19 to close the damper 20 in the outlet duct 16. Deenergization of the blower 17 creates in the housing 12 a static air condition that enhances the ability of the detectors 43 to detect combustion. Complete shut-off of air flow through the housing during run down of the blower 17 is effected by the closed damper 20.

Also deactivated by the control circuit 48 in response to a difference output signal on line 47 are the rotary airlock valve 31 and the agitator mechanism 24. Operation of those devices is terminated by the output signals on lines 51 and 52, respectively, to the airlock drive mechanism 32 and the agitator cyclic timer 50. Discontinuing operation of the airlock valve 31 prevents the removal from the housing 12 of particulate matter that could have been damaged by the detected fire while deactivation of the agitator 24 stops dislodgement from the bags 23 of particulate matter that could fuel the fire.

After the termination of air flow through the housing 12 and assuming the presence of fire therein, the ambient temperature will rapidly reach a given level and be detected by one or more of the detectors 43. A resultant detection signal on line 49 (FIG. 2) causes the control circuit 48 to produce an output signal on line 55 that opens the discharge valve 36. After opening of the valve 36, extinguishing agent within the vessel 35 is discharged through the discharge pipe 37 and the discharge nozzle 38 to extinguish the fire within the housing 12.

Obviously, many modifications and variations of the present invention are possible in light of the above teachings. For example only, inlet and outlet temperature sensors 41, 42 and combustion produces detectors 43 other than those specifically described can be used. Also, the invention can employ fire extinguishing agents other than the preferred halon 1301. It is to be understood, therefore, that the invention can be practiced otherwise than as specifically described.

What is claimed:

1. A fire suppression system comprising:

an enclosure for receiving particulate matter and defining an inlet opening and an outlet opening;

an input duct connected to said inlet opening;

air moving means for forcing air through said input duct into said enclosure, and out of said outlet opening;

inlet sensor means providing an inlet output signal dependent on the inlet temperature of combined gas and particulate matter entering said enclosure through said inlet opening;

outlet sensor means providing a discharge output signal dependent on the outlet temperature of air discharged through said outlet opening;

difference circuit means receiving said inlet and discharge output signals and providing a difference signal in response to a predetermined minimum difference therebetween;

a supply of fire extinguishing agent;

an actuator means operable to release said agent into said enclosure;

detector means for providing a detection signal in response to the presence of combustion products within said enclosure; and control circuit means receiving said detection signal and said difference signal; said control circuit means adapted to deactivate said air moving means in response to said difference signal and to activate said actuator means to release said agent in response to said detection signal.

2. A system according to claim 1 including filter means disposed in said enclosure and sealed between said inlet opening and said outlet opening so as to remove in said enclosure the particulate matter entrained by air entering said enclosure through said inlet opening.

3. A system according to claim 2 including shut-off means activatable to block air flow through said enclosure between said inlet and outlet openings, and wherein said control circuit means is further adapted to activate said shut-off means in response to said difference signal.

4. A system according to claim 3 including filter cleaning means activatable to remove particulate matter deposited on said filter means, and wherein said control circuit means is further adapted to deactivate said cleaning means in response to said difference signal.

5. A system according to claim 4 including removal means activatable to effect removal of particulate matter accumulated in said enclosure, and wherein said control circuit means is further adapted to deactivate said removal means in response to said difference signal.

6. A system according to claim 5 including an outlet duct connected to said outlet opening, and wherein said shut-off means is a damper disposed therein.

7. A system according to claim 6 wherein said detection means comprises temperature detection means.

8. A system according to claim 6 wherein each of said inlet and outlet sensor means comprises a thermocouple.

9. A system according to claim 1 including shut-off means activatable to block gas flow through said enclosure between said inlet and outlet openings, and wherein said control circuit means is further adapted to activate said shut-off means in response to said difference signal.

10. A system according to claim 9 including an outlet duct connected to said outlet opening, and wherein said shut-off means is a damper disposed therein.

11. A system according to claim 9 including filter means disposed in said enclosure and sealed between said inlet opening and said outlet opening so as to remove in said enclosure the particulate matter entrained by air entering said enclosure through said inlet opening.

12. A system according to claim 11 including filter cleaning means activatable to remove particulate matter deposited on said filter means, and wherein said control circuit means is further adapted to deactivate said cleaning means in response to said difference signal.

13. A system according to claim 12 including an outlet duct connected to said outlet opening, and wherein said shut-off means is a damper disposed therein.

14. A system according to claim 12 including removal means activatable to effect removal of particulate matter accumulated in said enclosure, and wherein said control circuit means is further adapted to deactivate said removal means in response to said difference signal.

15. A system according to claim 14 including an outlet duct connected to said outlet opening, and wherein said shut-off means is a damper disposed therein.

16. A system according to claim 2 including filter cleaning means activatable to remove particulate matter deposited on said filter means, and wherein said control circuit means is further adapted to deactivate said cleaning means in response to said difference signal.

17. A system according to claim 16 including removal means activatable to effect removal of particulate matter accumulated in said enclosure, and wherein said control circuit means is further adapted to deactivate said removal means in response to said difference signal.

18. A system according to claim 1 including removal means activatable to effect removal of particulate matter accumulated in said enclosure, and wherein said control circuit means is further adapted to deactivate said removal means in response to said difference signal.

19. A system according to claim 18 including shut-off means activatable to block air flow through said enclosure between said inlet and outlet openings, and wherein said control circuit means is further adapted to activate said shut-off means in response to said difference signal.

20. A system according to claim 1 and wherein said fire extinguishing agent is a hologenated extinguishing agent.

* * * * *